US007712181B2

(12) United States Patent
Riach

(10) Patent No.: US 7,712,181 B2
(45) Date of Patent: May 11, 2010

(54) HOPPER OPENING MECHANISM

(75) Inventor: Alan B. Riach, Bathgate (GB)

(73) Assignee: Applied Sweepers Limited, Falkirk (GB)

( * ) Notice: Subject to any disclaimer, the term of this patent is extended or adjusted under 35 U.S.C. 154(b) by 1145 days.

(21) Appl. No.: 10/548,899

(22) PCT Filed: Mar. 12, 2004

(86) PCT No.: PCT/GB2004/001077

§ 371 (c)(1),
(2), (4) Date: Jan. 23, 2006

(87) PCT Pub. No.: WO2004/081289

PCT Pub. Date: Sep. 23, 2004

(65) Prior Publication Data

US 2006/0236497 A1 Oct. 26, 2006

(30) Foreign Application Priority Data

Mar. 12, 2003 (GB) ..... 0305664.5

(51) Int. Cl.
*A47L 9/16* (2006.01)
*E01H 1/08* (2006.01)

(52) U.S. Cl. ..... 15/340.1; 15/340.3; 15/352; 15/353

(58) Field of Classification Search ..... 15/352, 15/353, 340.1–340.4; *A47L 9/16; E01H 1/08*
See application file for complete search history.

(56) References Cited

U.S. PATENT DOCUMENTS

| | | | | |
|---|---|---|---|---|
| 3,105,991 | A * | 10/1963 | Oberg | 15/320 |
| 3,406,423 | A * | 10/1968 | Young | 15/347 |
| 4,218,226 | A * | 8/1980 | Boozer | 96/414 |
| 5,596,788 | A | 1/1997 | Linville et al. | |
| 5,771,532 | A * | 6/1998 | Munnoch | 15/352 |
| 6,742,219 | B2 * | 6/2004 | Lenzmeier et al. | 15/345 |
| 2004/0045123 | A1 * | 3/2004 | Engel et al. | 15/347 |

FOREIGN PATENT DOCUMENTS

| | | | |
|---|---|---|---|
| DE | 40 32 240 | A | 4/1991 |
| DE | 101 18 500 | C | 8/2002 |
| EP | 0578442 | A1 | 1/1994 |
| JP | 10168846 | A | 6/1998 |

OTHER PUBLICATIONS

International Search Report dated Jul. 13, 2004.

* cited by examiner

*Primary Examiner*—David A Redding
(74) *Attorney, Agent, or Firm*—Stephen B. Salai, Esq.; Brian B. Shaw, Esq.; Harter Secrest & Emery LLP

(57) ABSTRACT

A hopper opening mechanism for a hopper in a suction sweeping machine, the opening mechanism comprising an actuator mechanism for opening the hopper for cleaning of the hopper, wherein the actuator mechanism rotates a lid or door of the hopper and a base of or a mesh screen for a cyclone unit for cleaning of otherwise inaccessible surfaces of the machine. A tipping mechanism for the hopper inverts and raises the hopper for tipping out the contents of the hopper At the same time, the door and mesh screen are opened for facilitating the cleaning of the inside of the hopper.

27 Claims, 5 Drawing Sheets

HOPPER OPENING MECHANISM

The present invention relates to a hopper opening mechanism, in particular for assisting in the cleaning of motorised suction sweeping machines used for clearing dirt and litter from streets and roads. The present invention also provides a method of opening or a method of tipping a suction sweeping machine comprising a hopper.

A suction sweeping machine generally comprises front rotary sweepers for gathering the dust and the like, water sprayers for wetting the dust and the like in dry weather, and a vacuum cleaning or suction mechanism for sucking the wetted dust and the like into the machine for collection in a hopper via a suction hose. Once the hopper is full, the machine is emptied and, if required, cleaned.

It is known to fit cyclone units into such suction sweeping machines. These cyclone units are provided for removing fine or small dirt and the like from the airflow generated by a main vacuum fan. Larger dirt and litter, which would damage the cyclone unit, is prevented from entering the cyclone unit by a mesh screen. The cleaned air is then vented from the machine, while the dirt and litter that has been extracted from the airflow is thrown by the cyclone unit into the hopper. The hopper, i.e. a container for collecting the dirt ant litter, when full, needs to be emptied. At the end of the day, the hopper is additionally cleaned. The cyclone unit, however, is a sealed unit. Therefore it is difficult to clean.

In order for these machines to remain efficient, the cyclone unit must function properly. However, if the mesh screen becomes clogged by the dirt and the like, the airflow into the cyclone unit will be impaired and the cyclone unit, which requires airflow to drive it, will lose efficiency. Therefore it is necessary to clean the mesh screen at least once a day, usually at the end of the day. Further, it is preferred to clean the cyclone unit occasionally. However, cleaning these machines, and in particular the mesh screen or the cyclone unit, is generally unpleasant, undesirable and difficult. It would therefore be desirable to provide a suction sweeping machine or cyclone unit therefore, that is easier to clean.

The present invention provides a hopper opening mechanism for a hopper in a suction sweeping machine, the opening mechanism comprising an actuator mechanism for opening the hopper for cleaning of the hopper, wherein the actuator mechanism also rotates a mesh screen for cleaning of an otherwise inaccessible surface the mesh screen.

Preferably the mesh screen is a filter for a cyclone unit.

The present invention also provides an opening mechanism for a cyclone unit and hopper in a suction sweeping machine, the opening mechanism comprising an actuator mechanism for opening both the cyclone unit and the hopper for cleaning of the cyclone unit and the hopper. Preferably a base of the cyclone unit is moved by the actuator mechanism relative to the rest of the cyclone unit to open the cyclone unit. Preferably the base is rotated.

Preferably the base has a portion of a mesh screen attached thereto, the mesh screen forming a filter for the cyclone unit.

The present invention also provides a cyclone unit and hopper comprising an opening mechanism for opening both the cyclone unit and the hopper.

The present invention also provides a suction sweeping machine comprising a cyclone unit, a hopper and an opening mechanism for opening both the cyclone unit and the hopper.

Preferably the actuator mechanism comprises a hydraulic piston.

Preferably the actuator mechanism is attached at one end to the inside of the hopper, and more preferably to the roof of the hopper.

Preferably the actuator mechanism is attached at one end to a lid or door of the hopper.

Preferably the actuator mechanism is attached at one end to a removable base of the cyclone unit.

Preferably the actuator mechanism is attached at one end to the removable base of the cyclone unit via a hinged portion of a mesh screen for the cyclone unit, the base being attached to the hinged portion of the mesh screen.

Preferably the actuator mechanism is attached to the lid or door of the hopper via a linkage mechanism. Preferably the actuator mechanism is attached to the mesh screen, or the base of the cyclone unit, or both, via a linkage mechanism. Preferably the linkage mechanism is attached to both the mesh screen and the lid or door of the hopper.

Preferably the actuator mechanism, upon actuation, will open the lid or door of the hopper by rotating it. Preferably the lid or door is rotated by about 60°.

Preferably the actuator mechanism, upon actuation, will rotate the mesh screen and base of the cyclone unit. Preferably they are rotated by about 34.4°.

Preferably there is a single actuator in the actuator mechanism.

Preferably there is a single lid or door for the hopper. Preferably the lid or door is hinged towards the front of the hopper. Preferably the hopper is positioned towards the rear of the suction sweeping machine.

Preferably the mesh screen is attached to the base of the cyclone unit using spacers to provide an air gap between the base of the cyclone unit and the hinged portion of the mesh screen. Preferably the air gap is about 20 mm.

Preferably the cyclone unit is inside the hopper. Preferably the cyclone unit is positioned towards the top and front of the hopper. Preferably the cyclone unit comprises an air vent for venting air to the atmosphere, out of the hopper. Preferably the air vent is positioned towards the top of the hopper.

Preferably the mesh screen effectively extends across the entire horizontal area of the hopper, just below the top thereof. Preferably the mesh screen is in two parts. Preferably a first part extends substantially horizontally, in its closed position, below the or each cyclone unit. Preferably a second part extends substantially horizontally, in its closed position, below the lid or door of the hopper. Preferably both parts are hinged. Preferably the first part is rotated by the actuator mechanism. Preferably the second part is hinged adjacent the junction thereof with the first part. Preferably the junction extends laterally across the hopper. Preferably the first part is hinged adjacent the front of the hopper, parallel to the hinge of the second part. Preferably a portion of the second part of the mesh screen is provided on the underside of the lid or door of the hopper, so that it is opened as the lid or door of the hopper is opened by the actuator mechanism.

Preferably a pair of cyclone units is provided. Preferably the cyclone units are laterally spaced. Preferably the actuator mechanism is positioned between the two cyclone units.

Preferably the hopper comprises a tipper mechanism for tipping the hopper about a hinge point for emptying the contents thereof through the lid or door of the hopper once the lid or door of the hopper has been opened by the actuator mechanism.

Preferably the lid or door of the hopper is provided at the top of the hopper in its untipped position.

Preferably the lid or door opens such that it moves away from the hinge point.

Preferably the mesh screen is rotated such that it moves away from the hinge point.

The present invention also provides a method for tipping a hopper of a suction sweeping machine comprising:

providing a suction sweeping machine having a hopper with a lid or door for tipping any contents of the hopper therefrom, the hopper being positioned towards the rear of the suction sweeping machine, the hopper comprising a tipping mechanism; and actuating the tipping mechanism to tip the hopper about a hinge point positioned substantially towards the top and rear of the suction sweeping machine.

Preferably the hopper, to tip out its contents, is rotated up and over the hinge point by about 110°.

Preferably, upon starting to tip the hopper, the hopper is moved rearwardly and upwards, while being rotated, to move it out of the suction sweeping machine such that, in its tipped position, it will hang substantially upside down, above and clear of the suction sweeping machine.

Preferably the hopper has a cyclone unit therein and an opening mechanism, for example as described above.

Preferably the opening mechanism opens a lid or door of the hopper and opens a base of the cyclone unit to move them into a cleaning position prior to tipping of the hopper.

The present invention will now be described, by way of example only, with reference to the accompanying drawings in which.

Figure 3:
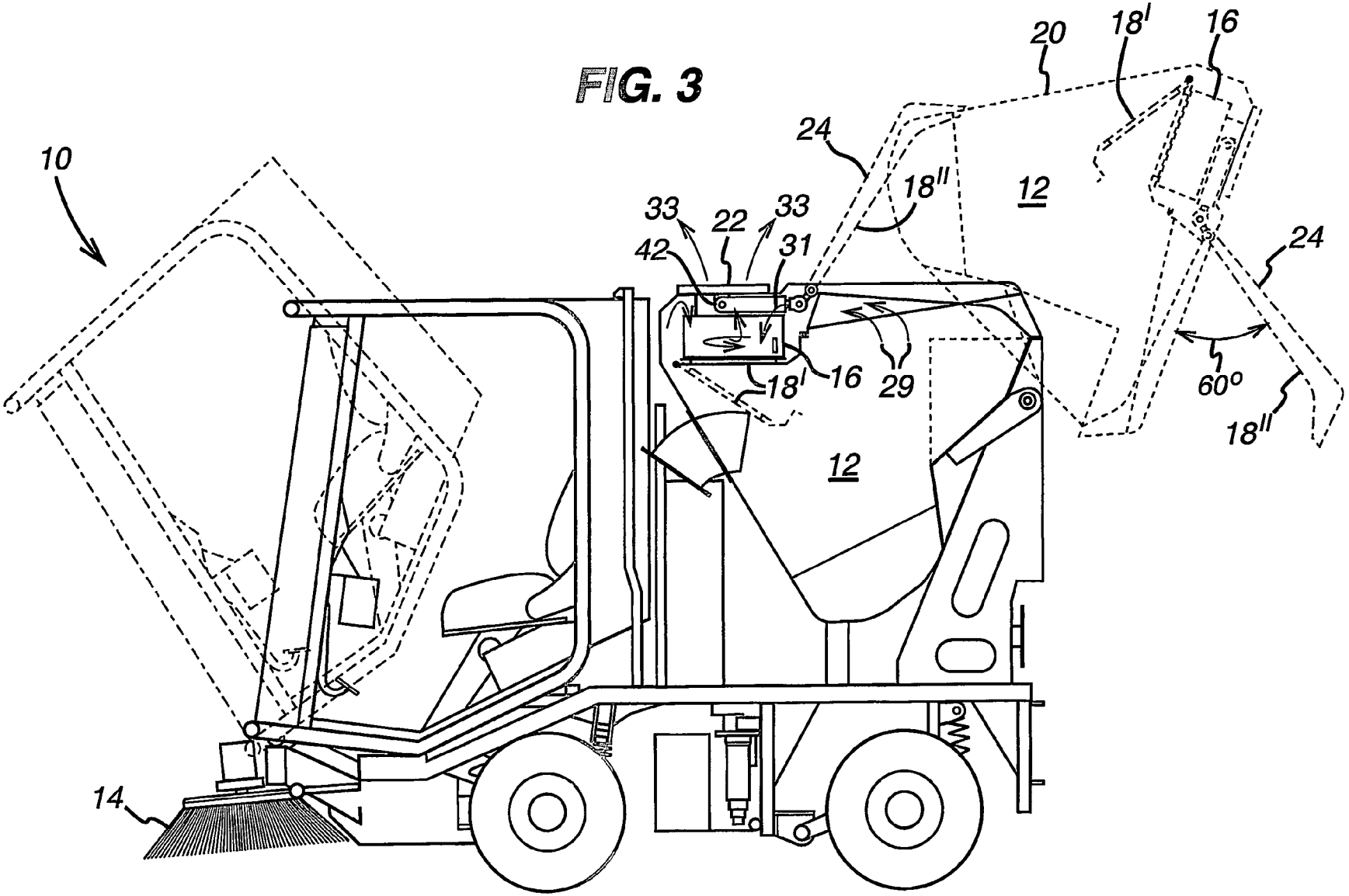
FIG. 3 shows in elevation a suction sweeping machine incorporating the opening mechanism of the present invention in an opened state.

Referring now to FIG. 3, there is shown a small sweeper or suction sweeping machine 10 that uses a centrifugal fan (not shown) to suck up dirt and dust in all weathers. It passes the dirt and dust via a pick up hose (not shown) through the fan, which compacts this material and blows it into a hopper 12. Once the hopper 12 is full, the hopper is emptied by tipping out its contents. The hopper 12 is shown in its tipping position 20 and its non tipping position 22. Instead of a fan through which the dirt passes, however, the system may operate using a vacuum source to pull the dirt into the hopper.

In dry or damp conditions water is sprayed from the front brushes 14 onto the ground to prevent airborne dust from being created by the brushes, and also into the front of the pick up hose to treat dusty air or to prevent the hose becoming blocked with sticky dirt. Water is also sprayed at the top of the hose before the fan.

As dusty material, with the water, enters the casing of the fan, the mixing and compacting properties of the fan agglomerates the majority of the dry/dusty material swept and sucked up off the ground to form heavy dirt before it enters the hopper.

A system of baffles in the main body of the hopper spins the material, air and water mixture in the hopper, creating a cyclone effect. The baffles are placed in the corners of the hopper and when air, water, dirt and dust enter the hopper, it does so at the near side of the hopper. Together with the baffles the mixture is set spinning with the heavy dirt being thrown against the walls of the hopper and lighter material settling into the 'dead' air area at the centre of the hopper. A sample device incorporating this technology is the original Applied 525 sweeping machine, from the present applicants. Further description of this basic cyclone effect, therefore, is not required.

The machine shown in FIG. 3, however, comprises a secondary cleaning system not found in the original Applied 525 sweeping machine. Referring in particular to FIG. 4, the hopper 12 is again shown, but in more detail. The hopper 12 has therein a pair of cyclone units 16 (one shown). A cyclone unit 16 is provided on each side of the machine 10.

A mesh screen 18 is provided inside the hopper 12 to extend substantially across the entire horizontal extent of the hopper 12, just below the top 50 of the hopper 12, but below the cyclone units 16. In the figures, the mesh screen 18 is shown to comprise multiple component parts 18', 18", 18'''. They are all hinged so that they can be opened for cleaning both sides thereof.

A first part is positioned below the cyclone units 16. It is shown in an open or downwardly rotated position 18' as well as the closed position. It can be rotated about a hinge 19 adjacent the front of the hopper 12. When the cyclone units are operating, however, this part of the mesh screen 18 will be closed (reference sign 30 in FIG. 5).

A second part 18" is provided on the underside of the lid or door 24 of the hopper 12. It is hinged adjacent the hinge 23 of the lid or door 24.

The third part 18''' is hinged about a laterally extending hinge 25 towards the middle of the hopper 12.

The air that has been partially cleaned by the main cyclone formed by the baffles passes through the mesh screen 18 towards the roof of the hopper 12. These mesh screen entraps material to prevent certain large grades of material from entering the cyclone units 16. Much of this entrapped material will then fall into the hopper.

Depending on conditions of the dirt on the ground, some material will pass through the mesh screen 18. This is typically light, dusty material that has not been agglomerated by the water dust suppression system. It is this material that then passes through the twin, roof mounted, cyclone units 16.

Figure 1:
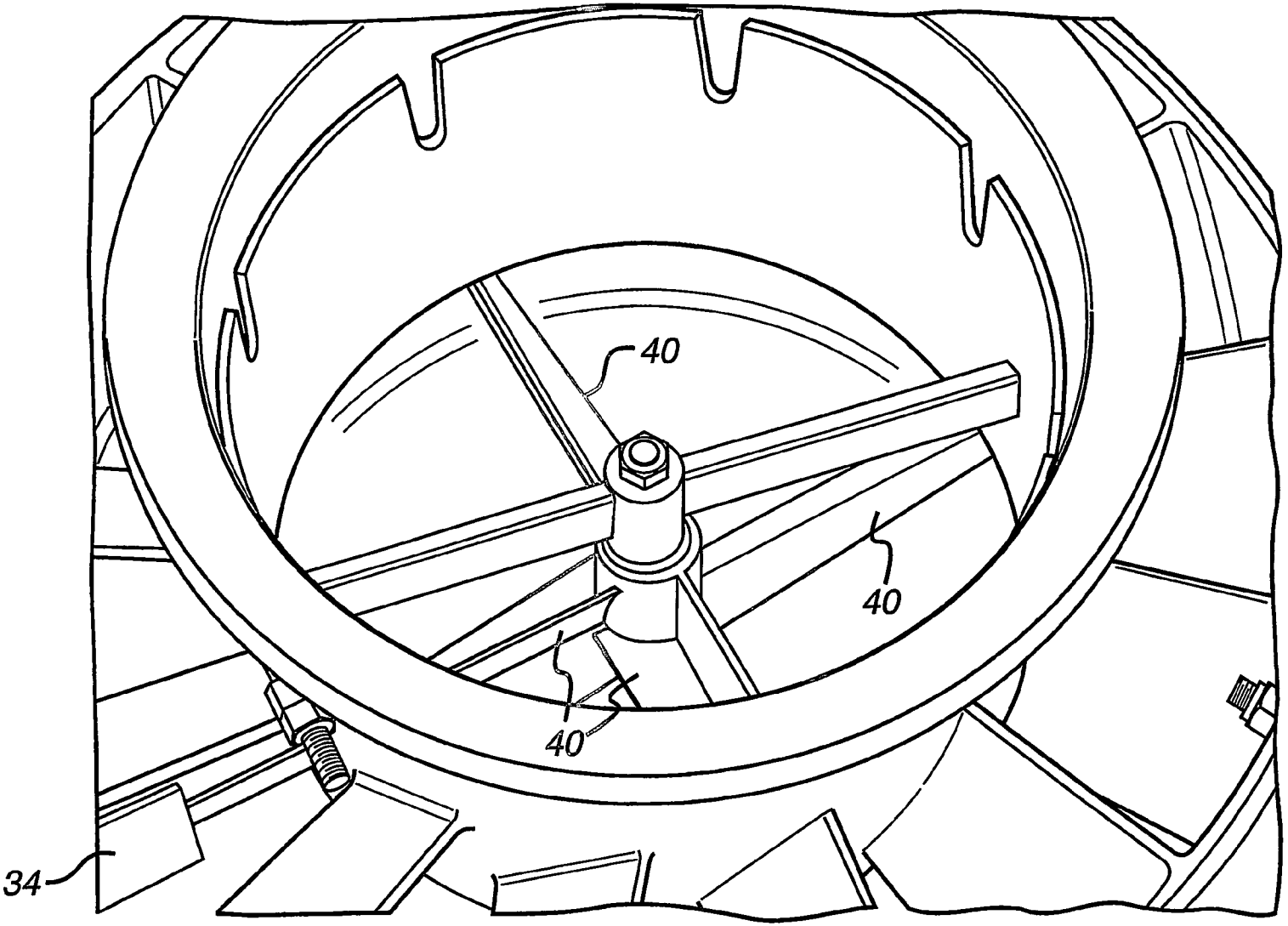
FIG. 1 shows a detailed perspective view from the top of a preferred cyclone unit for a suction sweeping machine.

Cyclone units are normally designed individually to handle a certain flow of air at a certain pressure. The material the cyclones are designed to separate normally does not change. It is either wet or dry and normally of a predetermined size. The material passing through the mesh screens 18 into the cyclone units 16 will be dry or wet depending on the conditions of the street. The cyclone unit shown in FIGS. 1 and 2 will handle both wet and dry dirt.

Figure 2:
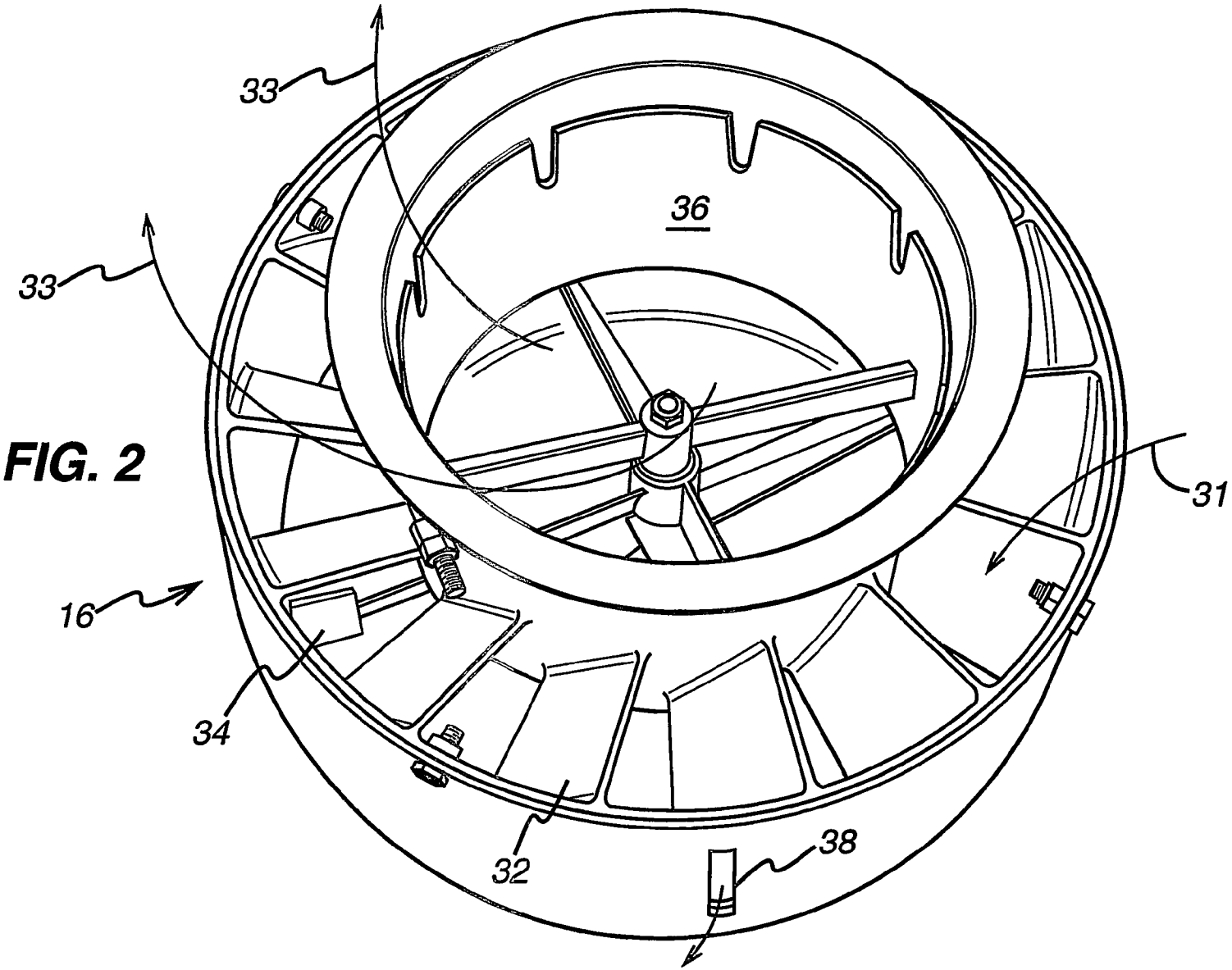
FIG. 2 shows a perspective view of the cyclone unit of FIG. 1.

Referring to FIG. 2, each cyclone unit 16 comprises stationary, angled blades (or fins) 32, a spinner 34 underneath them (shown more clearly in FIG. 5), and a central air venting core. The spinner comprises four arms 40 (one shown having a paddle on the end—each arm, however, will generally have a paddle). The side wall of the cyclone unit 16 has at least one dirt slot 38 therein for the dirt to exit the cyclone unit 16. The base of the cyclone unit 16 is made of a solid steel plate 39. The plate 39 can be moved relative to the rest of the cyclone unit 16 to open up the cyclone unit for cleaning it.

Figure 4:
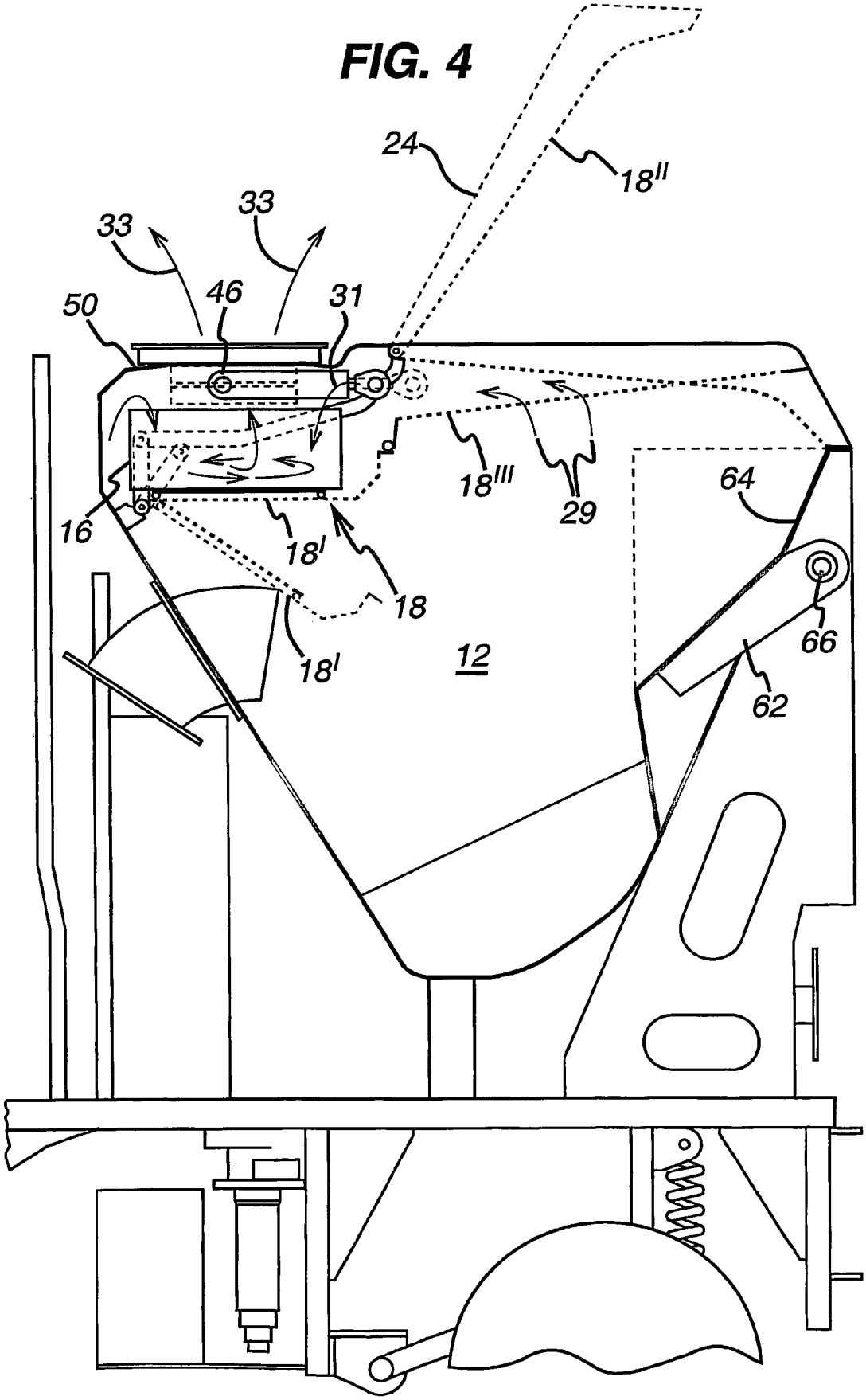
FIG. 4 shows in elevation the hopper and cyclone unit of the machine of FIG. 3 prior to tipping of the hopper.
Figure 5:
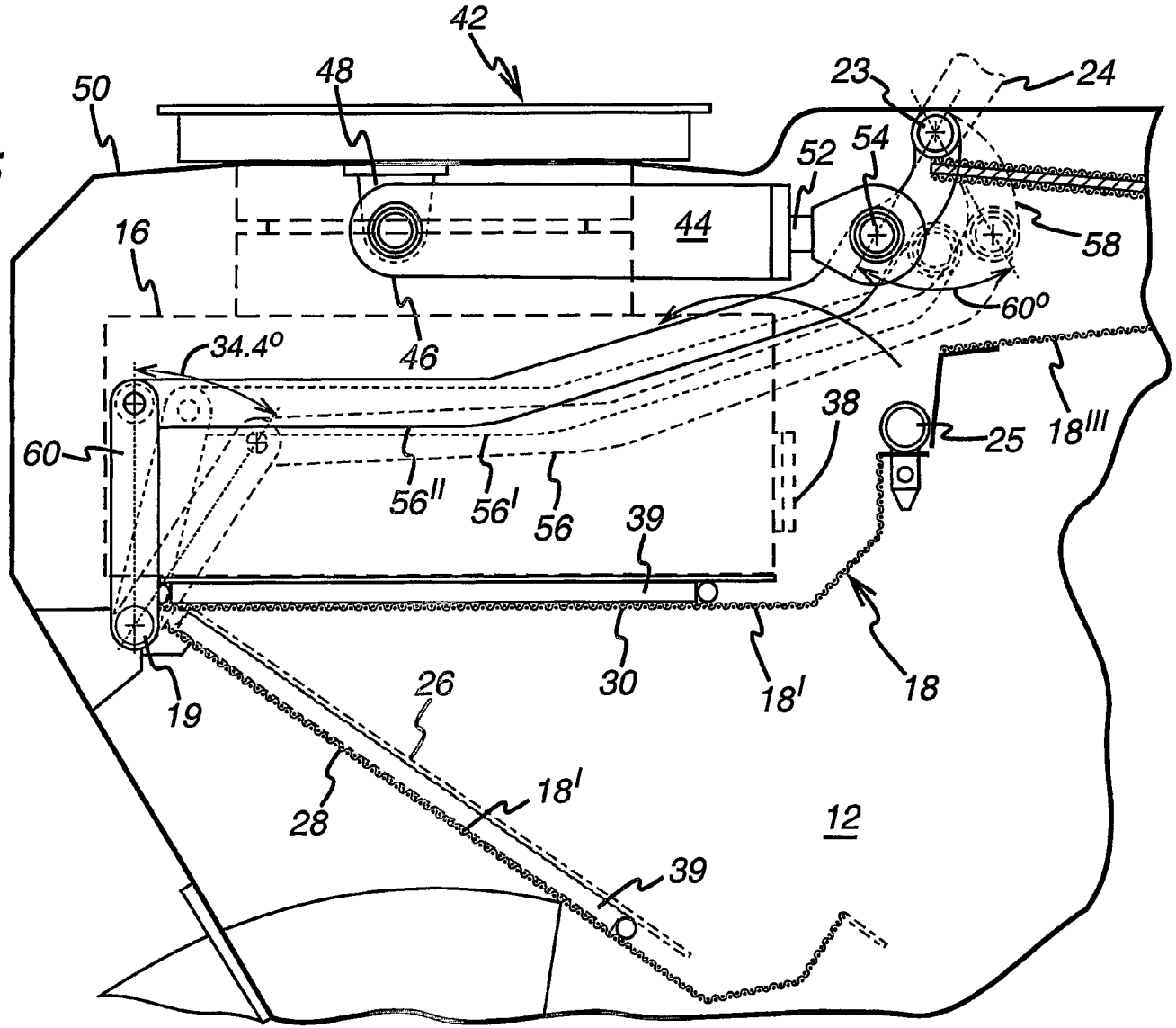
FIG. 5 shows in elevation details of a linkage mechanism for operating the opening mechanism of the present invention.

Referring to FIGS. 2, 4 and 5, after dusty or dirty air has passed 29 through the mesh screen 18, the dusty or dirty air will enter 31 the cyclone units 16. Then it passes through the angled blades 32. They cause the air to spin at high speed around the cyclone unit 16. The slot or slots 38 in the external wall of the cyclone units then allows the heavier than air material to pass out of the cyclone unit for collection in the hopper 12. The spinner 34 (a propeller-like unit) spins with the air causing the 'boundary' air in the cyclone unit to be at a higher velocity and so more efficient at displacing the dirt therefrom. The cleaned air will then pass to the inside of the cyclone unit and exit 33 upwards through the central core 36.

The heavier than air material passing out of the cyclone unit for collection in the hopper 12 may pass back through the mesh into the hopper or may collect on the cyclone unit side of the mesh screen 18.

The operation of the cyclone units 16 will be readily understood by a skilled person in the art of cyclone based dirt/air separation units. Therefore further description of the cyclone units 16 is not required.

Dirt and dust will build up in and around the area where the cyclone units 16 are housed. Further, if wet or damp material passes through the cyclone units 16, the centrifugal forces will cause the dirty material to be thrown against the cyclone units inside walls. Although non sticky dirt will pass through the dirt slots into the hopper, glutinous material will stick against the wall of the cyclone (as it does in the hopper area and generally around the sweeping equipment). Therefore, it is useful to be able to wash down the internal mechanisms of the suction sweeping machine 10, the mesh screen and the inside of the cyclone units regularly and easily to keep the machine 10 operating properly and at maximum efficiency.

The present invention provides a mechanism for facilitating the cleaning operation of the internal mechanisms of the hopper and cyclone unit.

As shown in FIG. 5, the base of the cyclone unit 16 (steel plate 39), which is attached to the hinged part 18' of the mesh screen 18, swings down and away from the rest of the cyclone unit 16 to open up the interior of the cyclone unit 16. This facilitates the cleaning of the interior of the cyclone unit 16.

In order to operate the opening of the mesh screen, an actuator mechanism 42 is provided. The actuator mechanism 42 comprises a hydraulic cylinder 44 attached at a first end 46 to a bracket 48 on the inside surface 50 of the roof of the hopper 12. At the other end of the cylinder 44 there is a piston 52, operable with the cylinder 44 to form a hydraulic ram. The piston 52 connects at its operative end 54, i.e. the end distal to the first end 46 of the cylinder 44, to a linkage mechanism 56 that is operatively connected to both a lid or door 24 for the hopper 12 and the hinged part 18' of the mesh screen 18.

The linkage mechanism 56 comprises a link arm that is connected to both a lever arm for the lid or door 24 of the hopper 12 and to a lever arm 60 for the hinged part 18' of the mesh screen 18. The lengths of the two lever arms are different so that the angles to which the lid or door 24 and the hinged part 18' of the mesh screen 18 will open upon operation of the actuating mechanism will be different. The angles are shown to be 60° and 34.4°, respectively.

The linkage mechanism is shown in three separate positions in FIG. 5 (and in FIG. 4). Reference sign 56 is for the open position. Reference sign 56' represents an intermediate position. Reference sign 56" represents a closed position.

The suction sweeping machine also comprises a tipping mechanism for the hopper 12. Referring to FIG. 4, the tipping mechanism comprises a hinge arm 62 that is welded or bolted to the rear wall 64 of the hopper 12. The hinge arm has a hinge point 66 positioned substantially towards the rear and top of the hopper. A hydraulic ram (not shown) operates against the hinge arm 62 to rotate the hopper 12 up and over the hinge point 66 by about 110° into an inverted and raised position (tipping position 20) as shown in FIG. 3.

To empty the hopper, the suction sweeping machine is first positioned such that it is backed up to a skip, or the like, for receiving the dirt from the hopper 12. Then a user operates the tipping mechanism to tip out the contents of the hopper 12 into the skip.

The actuator mechanism for the door 24 of the hopper and the hinged part 18' of the mesh screen 18 will be operable in conjunction with the tipping mechanism such that the actuator mechanism can be operated either before the tipper mechanism is operated, or as the tipper mechanism is operated.

At the end of each day, the hopper 12, the mesh screen 18 and the cyclone units 16 will need to be washed out. To do this a user, after tipping out the contents of the hopper 12 as best as possible by operating the tipping mechanism while the machine is positioned backed up to the skip, will move the machine 10 forward without untipping the hopper to allow him to stand behind the machine 10. The user will then wash down the inside of the hopper 12, for example using a high pressure hose.

As shown in FIG. 3, in the tipping position 20 the hopper 12 is rotated to be positioned above and behind the suction sweeping machine 10. Further, the lid or door 24 of the hopper 12 is opened. Further, the mesh screen 18 will also be open. These three features provide for simple access to the dirty parts of the internal mechanisms of the hopper, the mesh screen and cyclone units, thereby facilitating the cleaning process for the hopper, the mesh screen and the cyclone units; access to the inside of the hopper 12 and both surfaces of each part of the mesh screen 18 is provided through the lid or door of the hopper since the mesh screen parts are hinged so that water can be sprayed on the inside surface of the hopper 12 and also the both surfaces 26 of the various parts of the mesh screen 18 to displace any accumulated dirt from the outside surface 28 of the mesh screen 18—water can push through the mesh screen to force out entrapped dirt. Further, with a hooked hose, the inside of the cyclone unit can also be washed out easily.

As the sweeper has to operate in all weathers and be kept clean in order to be at its most efficient it is important that all areas of the sweeper involved in filtration of dirty air can be cleaned. Further, knowing the reluctance of most operators to perform this unpleasant job, it is important that the cleaning is made as easy and accessible as possible. It is for this reason that the present invention makes the cyclone units and the mesh screen, i.e. the filters, split or open automatically whenever the machine is emptied. This facilitates the cleaning of the internal components of the suction sweeping machine 10, and in particular otherwise inaccessible areas and components of the machine 10.

The present invention has been described above purely by way of example. Modifications in detail, however, may be made to the invention as defined in the claims appended hereto.

The invention claimed is:

1. A hopper opening mechanism of a hopper in a suction sweeping machine of the type comprising a cyclone unit having stationary, angled, blades for forming a cyclone effect, the opening mechanism comprising an actuator mechanism for opening the hopper for cleaning of the hopper, wherein the actuator mechanism also rotates a mesh screen for cleaning of an inaccessible surface of the mesh screen, wherein the mesh screen is part of a filter for the cyclone unit.

2. The hopper opening mechanism of claim 1, wherein a base of the cyclone unit is attached to the mesh screen, the opening mechanism thereby also opening the cyclone unit.

3. A hopper for a suction sweeping machine, comprising a cyclone unit having stationary, angled, blades for forming a cyclone effect and an opening mechanism for the cyclone unit and hopper, the opening mechanism comprising an actuator mechanism for opening both the cyclone unit and the hopper for cleaning of the cyclone unit and the hopper, wherein the actuator mechanism, upon actuation, will rotate a base of the cyclone unit to open the cyclone unit.

4. A hopper according to claim 3, wherein the actuator mechanism also rotates a mesh screen for cleaning of an inaccessible surface of the mesh screen, wherein the mesh screen is part of a filter for the cyclone unit.

5. The hopper of claim 4, wherein the actuator mechanism is attached at one end to the inside of the hopper.

6. The hopper of claim 4, wherein the actuator mechanism is attached at one end to a lid or door of the hopper.

7. The hopper of claim 4, wherein the actuator mechanism is attached at one end to the base of the cyclone unit.

8. The hopper of claim 4, wherein the actuator mechanism is attached at one end to a mesh screen, the base of the cyclone unit being attached to the mesh screen.

9. The hopper of claim 4, wherein the actuator mechanism is attached to a lid or door of the hopper via a linkage mechanism.

10. The hopper of claim 4, wherein the actuator mechanism is attached to the base of the cyclone unit via a linkage mechanism.

11. The hopper of claim 4, wherein the actuator mechanism, upon actuation, will open the lid or door of the hopper by rotating it.

12. The hopper of claim 4, wherein there is a single actuator in the actuator mechanism.

13. The hopper of claim 4, wherein the cyclone unit is inside the hopper.

14. The hopper of claim 4, wherein the cyclone unit is one a pair of cyclone units and the actuator mechanism is positioned between the pair of cyclone units.

15. The hopper of claim 4, wherein the hopper comprises a tipper mechanism for tipping the hopper for emptying any contents thereof through a lid or door of the hopper once the lid or door of the hopper has been opened by the actuator mechanism.

16. A suction sweeping machine comprising a cyclone unit having stationary, angled, blades for forming a cyclone effect, a hopper and an opening mechanism comprising an actuator mechanism for opening the hopper for cleaning of the hopper, wherein the actuator mechanism also rotates a mesh screen for cleaning of an inaccessible surface of the mesh screen, wherein the mesh screen is part of a filter for the cyclone unit.

17. The suction sweeping machine of claim 16 the opening mechanism being for opening both the cyclone unit and the hopper.

18. The suction sweeping machine of claim 16, comprising a cyclone unit having stationary, angled, blades for forming a cyclone effect and an opening mechanism for the cyclone unit and hopper, the opening mechanism comprising an actuator mechanism for opening both the cyclone unit and the hopper for cleaning of the cyclone unit and the hopper wherein the actuator mechanism also rotates a mesh screen for cleaning of an inaccessible surface of the mesh screen, wherein the mesh screen is part of a filter for the cyclone unit.

19. The suction sweeping machine of claim 16, further comprising a centrifugal fan to suck up road dirt and to blow if through a hose into the hopper, the blow from the fan causing air flow through the cyclone unit to cause the cyclone effect to separate dirt from the air flow.

20. A method for tipping a hopper of a suction sweeping machine of the type comprising a cyclone unit having stationary, angled, blades for forming a cyclone effect, a hopper and an opening mechanism comprising an actuator mechanism for opening the hopper for cleaning of the hopper, wherein the actuator mechanism also rotates a mesh screen for cleaning of an inaccessible surface of the mesh screen, wherein the mesh screen is part of a filter for the cyclone unit, the method comprising:

providing a hopper with a lid or door for tipping any contents of the hopper therefrom, the hopper being positioned towards the rear of the suction sweeping machine, the hopper comprising a tipping mechanism; and actuating the tipping mechanism to tip the hopper about a hinge point positioned substantially towards the top and rear of the suction sweeping machine.

21. The method of claim 20, wherein the cyclone unit is within the hopper as it is tipped.

22. The method of claim 20 wherein the hopper, to tip out its contents, is rotated by about 110°.

23. The method of claim 20, wherein, upon starting to tip the hopper, the hopper is moved rearwardly and upwards, while being rotated, to move it out of the suction sweeping machine such that, in its tipped position, it will hang substantially upside down, above and clear of the suction sweeping machine.

24. The hopper of claim 4, wherein a base of the cyclone unit is attached to the mesh screen, the opening mechanism thereby also opening the cyclone unit.

25. The suction sweeping machine of claim 16, wherein a base of the cyclone unit is attached to the mesh screen, the opening mechanism thereby also opening the cyclone unit.

26. The method of claim 23, wherein, upon starting to tip the hopper, the hopper is moved rearwardly and upwards, while being rotated, to move it out of the suction sweeping machine such that, in its tipped position, it will hang substantially upside down, above and clear of the suction sweeping machine.

27. The method of claim 21 wherein the hopper, to tip out its contents, is rotated by about 110°.

* * * * *